US009382760B2

(12) United States Patent
Le et al.

(10) Patent No.: US 9,382,760 B2
(45) Date of Patent: Jul. 5, 2016

(54) PULSING TOOL

(75) Inventors: Tuong Thanh Le, Katy, TX (US); Michael Dean Rossing, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 464 days.

(21) Appl. No.: 13/590,877

(22) Filed: Aug. 21, 2012

(65) Prior Publication Data

US 2013/0048386 A1 Feb. 28, 2013

Related U.S. Application Data

(60) Provisional application No. 61/526,639, filed on Aug. 23, 2011.

(51) Int. Cl.

| | |
|---|---|
| ***E21B 7/24*** | (2006.01) |
| ***E21B 23/14*** | (2006.01) |
| ***E21B 28/00*** | (2006.01) |

(52) U.S. Cl.

CPC . *E21B 7/24* (2013.01); *E21B 23/14* (2013.01); *E21B 28/00* (2013.01)

(58) Field of Classification Search

CPC ..... E21B 7/24; E21B 28/00; E21B 23/14; E21B 21/103

USPC ..... 166/177.6; 175/55, 56

See application file for complete search history.

(56) References Cited

U.S. PATENT DOCUMENTS

| | | | | |
|---|---|---|---|---|
| 2,780,438 | A | 2/1957 | Bielstein | |
| 3,899,033 | A | 8/1975 | Van Huisen | |
| 4,890,682 | A * | 1/1990 | Worrall et al. | 175/61 |
| 6,073,708 | A * | 6/2000 | Brown et al. | 175/93 |
| 6,289,998 | B1 * | 9/2001 | Krueger et al. | 175/25 |
| 6,439,318 | B1 | 8/2002 | Eddison et al. | |
| 6,508,317 | B2 * | 1/2003 | Eddison et al. | 175/107 |
| 7,405,998 | B2 | 7/2008 | Webb et al. | |
| 7,617,886 | B2 | 11/2009 | Hall | |
| 8,162,078 | B2 | 4/2012 | Anderson | |
| 9,222,312 | B2 | 12/2015 | Anderson | |
| 2002/0117306 | A1 * | 8/2002 | Hahn et al. | 166/373 |
| 2005/0230101 | A1 * | 10/2005 | Zheng et al. | 166/177.6 |
| 2009/0266612 | A1 * | 10/2009 | Allahar et al. | 175/55 |

FOREIGN PATENT DOCUMENTS

| | | | |
|---|---|---|---|
| CA | 2680895 | A1 | 3/2011 |
| EP | 1379757 | B1 | 1/2004 |

OTHER PUBLICATIONS

Dictionary Definition: "nozzle"; Merriam-Webster Dictionary; http://www.merriam-webster.com/dictionary/nozzle.*

"Inlet" Dictionary Definition; http://dictionary.reference.com/browse/inlet.*

(Continued)

*Primary Examiner* — Blake Michener

*Assistant Examiner* — Christopher Sebesta

(74) *Attorney, Agent, or Firm* — Patterson & Sheridan, LLP

(57) ABSTRACT

A pulsing tool for use with a tubular string having a motor unit and a pulsing unit coupled to the motor unit. In one embodiment, the pulsing unit includes a mandrel having an inlet opening and an outlet opening and a flow control bushing, wherein rotation of the mandrel relative to the flow control bushing creates a pressure oscillation which causes movement of the tubular string.

30 Claims, 12 Drawing Sheets

(56) References Cited

OTHER PUBLICATIONS

"Outlet" Dictionary Definition; http://dictionary.reference.com/browse/outlet.*

Canadian Office Action for Canadian Patent Applicaton No. 2,787,570, dated Aug. 7, 2014.

EP Search Report for Application No. 12181414.9-1610/ 2562350 dated Mar. 2, 2016.

* cited by examiner 300
310

345
330
315

362
350

PULSING TOOL

CROSS-REFERENCE TO RELATED APPLICATIONS

This application claims benefit of U.S. Provisional Patent Application Ser. No. 61/526,639, filed Aug. 23, 2011, which application is incorporated herein incorporated by reference in its entirety.

BACKGROUND OF THE INVENTION

1. Field of the Invention

Embodiments of the invention generally relate to a pulsing tool for reducing frictional forces encountered by a conveyance string during operation.

2. Description of the Related Art

One of the difficulties coiled tubing "CT" operations encounter is the inability to reach total depth due to high drag forces. The nature of coiled tubing is such that the drill string is not capable of being rotated, so a rotating friction reduction tool is not a viable option. Another limiting factor is that the operations are generally run in very tight or small diameter holes. In some cases, CT operations are performed to refurbish existing wells where mineral buildup and other factors have hindered the flow of oil or gas. The average diameter for a CT is only 2⅞ inches, whereas a standard operation using jointed drill pipe may run pipe ranging from 4 inches to 8 inches, in holes of up to 36 inches in diameter. Additionally, if the wellbore has horizontal sections, high frictional drag forces may be generated when the CT is lying on the bottom side of the wellbore.

There is a need, therefore, for apparatus and methods to reduce the frictional forces encountered by the conveyance string during operation.

SUMMARY OF THE INVENTION

A pulsing tool for use with a tubular string having a motor unit and a pulsing unit coupled to the motor unit. In one embodiment, the pulsing unit includes a mandrel having an inlet opening and an outlet opening and a flow control bushing, wherein rotation of the mandrel relative to the flow control bushing creates a pressure oscillation which causes movement of the tubular string.

In another embodiment, a method of moving a tubular string includes coupling the string to a pulsing tool having a motor unit; a pulsing unit having an inlet opening and an outlet opening configured to generate a pressure oscillation in the tubular string; flowing a fluid through the motor unit and then into the pulsing unit via the inlet opening; and periodically allowing the fluid to flow out of the pulsing unit via the outlet opening, thereby generating the pressure oscillation to cause the string to move.

In another embodiment, a pulsing tool for use with a tubular string includes a housing; a rotatable mandrel disposed in the housing, the mandrel having an inlet opening and an outlet opening; and a flow control bushing disposed between the housing and the mandrel, wherein rotation of the mandrel relative to the flow control bushing creates a pressure oscillation which causes movement of the tubular string.

In one embodiment, a pulsing tool uses pressure oscillations to reduce friction and help a coiled tubing to "skip" along the wellbore. The pressure oscillations cause the coiled tubing to straighten when pressure is increased and to flex when pressure is decreased. As a result, the coiled tubing is constantly moving during operation. The constant movement of the coiled tubing minimizes the static friction generated when the coiled tubing comes into contact with the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a pulsing tool for reducing frictional forces encountered by a conveyance string during operation.

Figure 1:
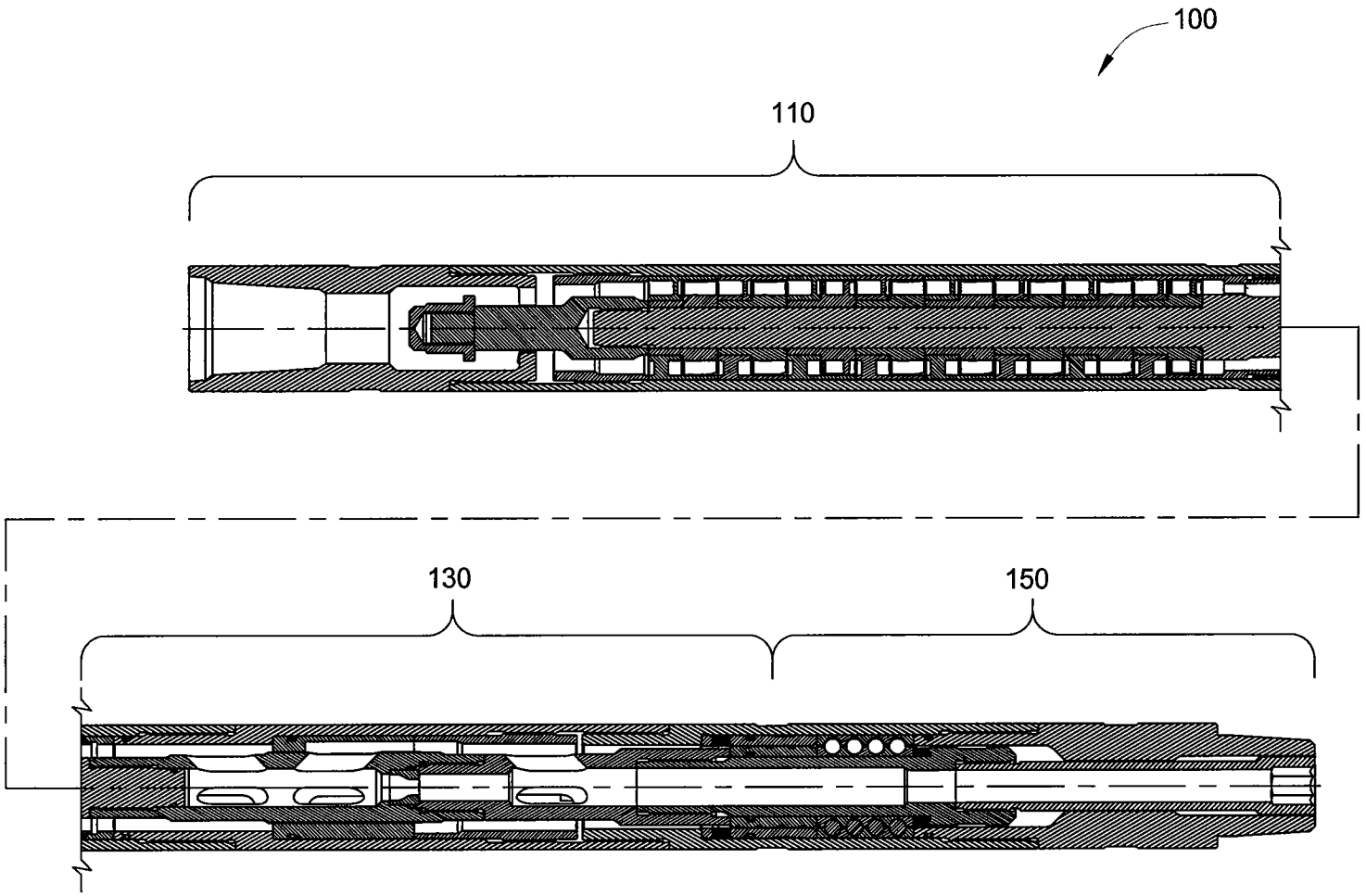
FIG. 1 is a cross-sectional view of an exemplary embodiment of a pulsing tool.
Figure 1A:
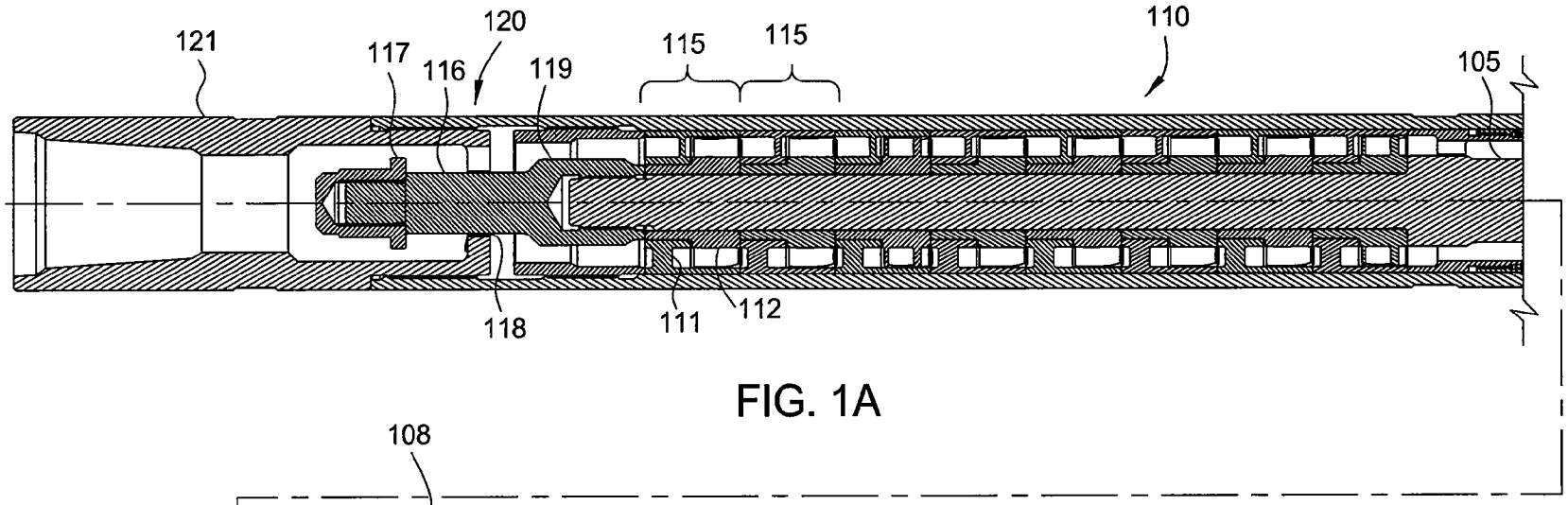
FIGS. 1A-1C show enlarged partial cross-sectional views of FIG. 1.
Figure 1B:
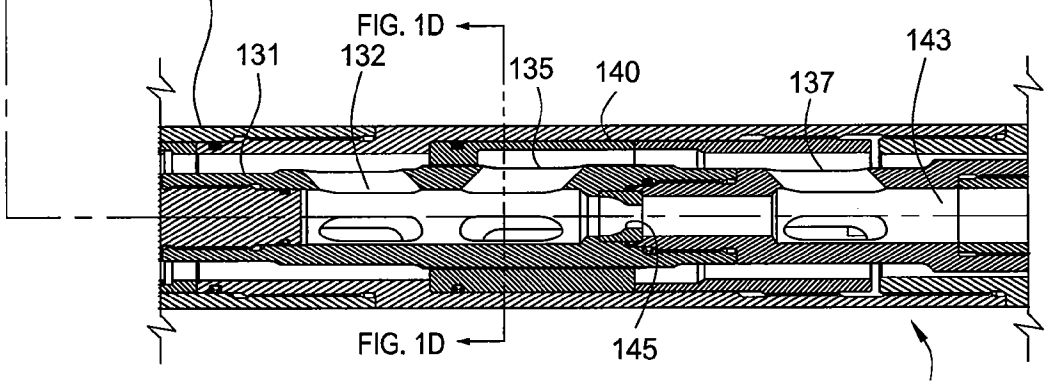
Figure 1C:
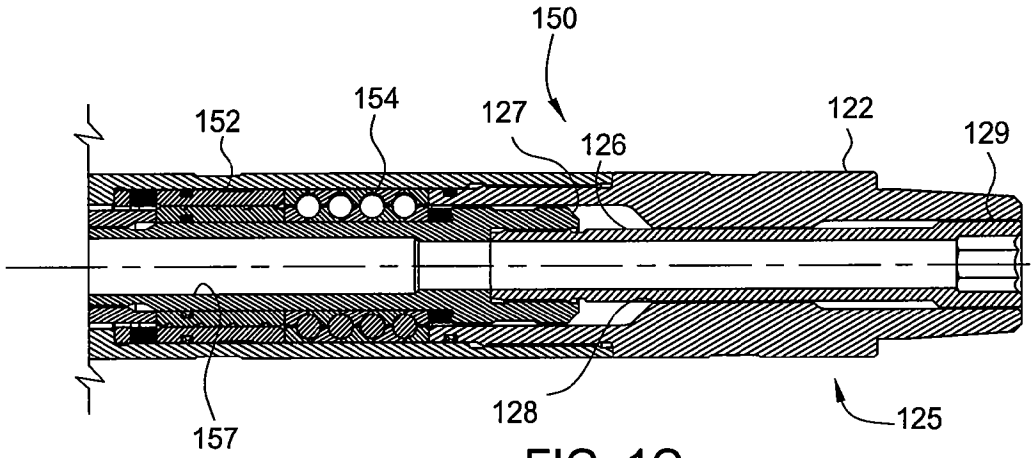
Figure 2:
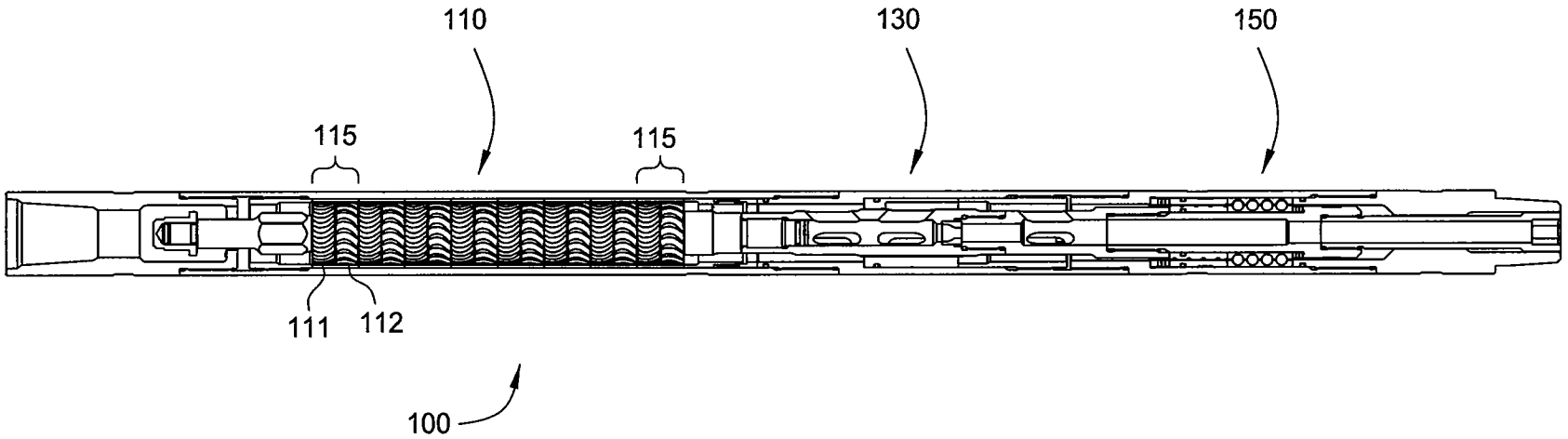
FIG. 2 is a cross-sectional view of the pulsing tool of FIG. 1.
Figure 2A:
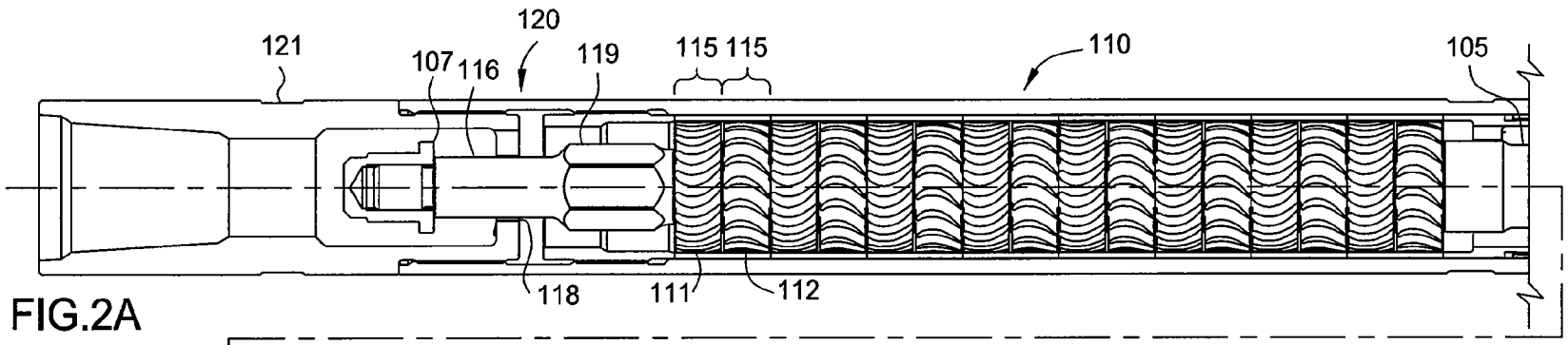
FIGS. 2A-2C are enlarged partial cross-sectional views of FIG. 2.
Figure 2B:
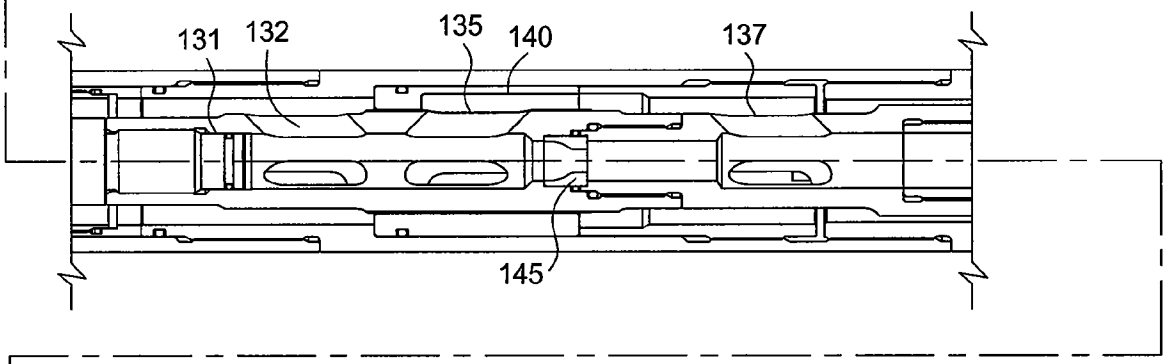
Figure 2C:
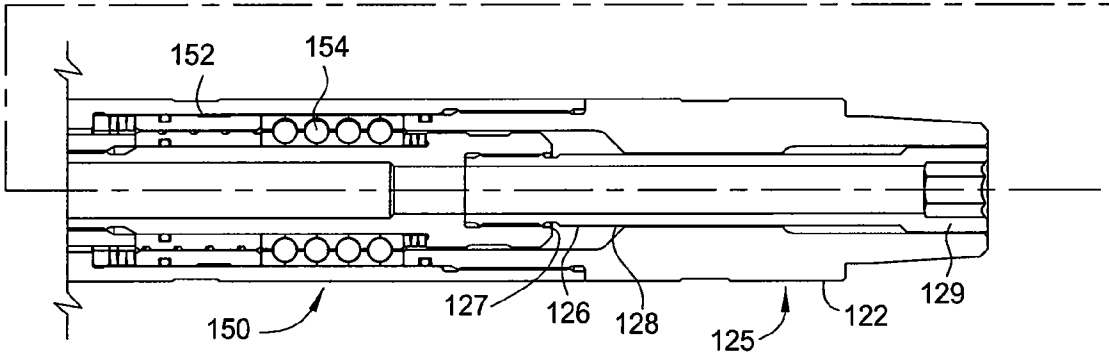
Figure 2D:
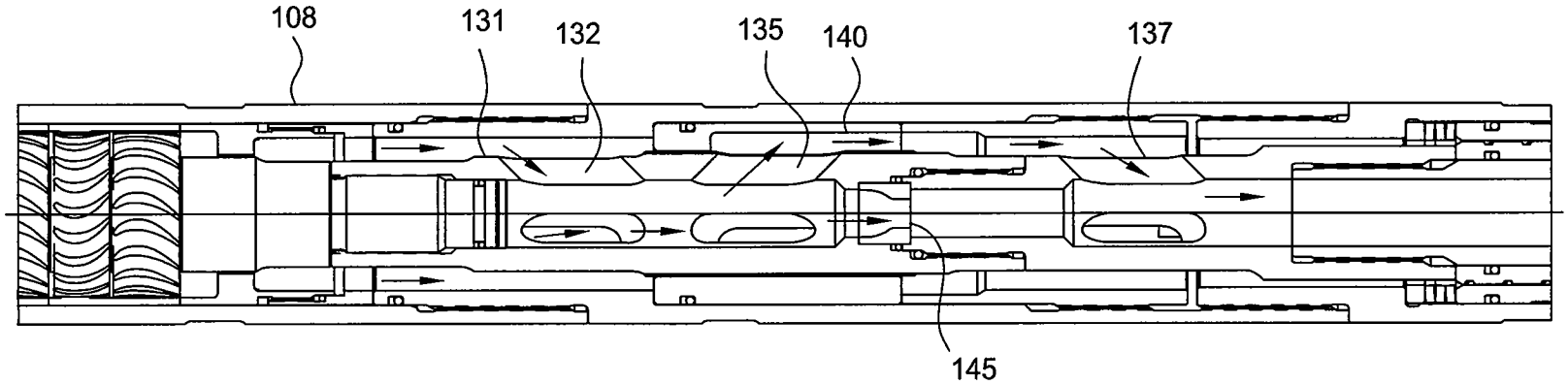
FIGS. 2D-2E are, respectively, open and close positions of the pulsing tool.
Figure 2E:
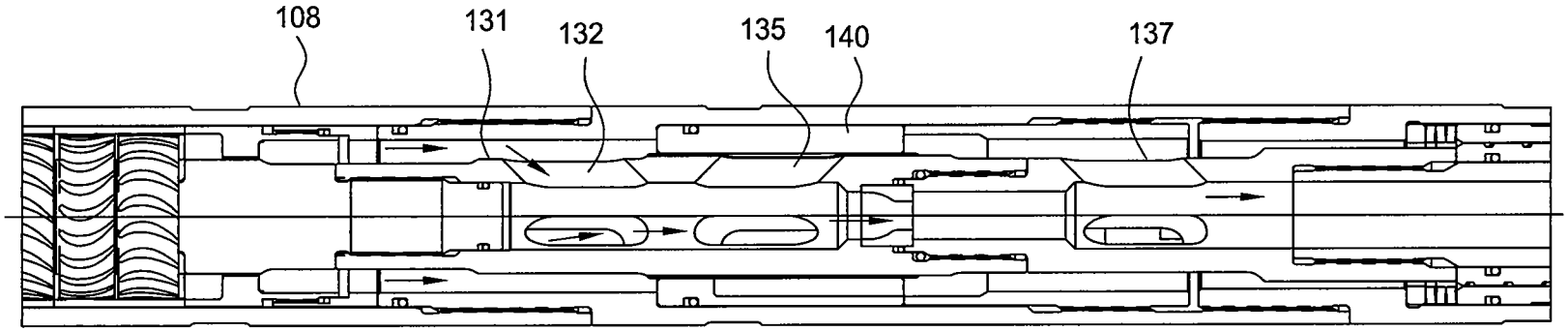

FIG. 1 shows a cross-sectional view of one embodiment of a pulsing tool 100. FIGS. 1A-1C are enlarged partial cross-sectional views of FIG. 1. FIG. 2 is a partial cross-sectional view of the pulsing tool 100 of FIG. 1. FIGS. 2A-2C are enlarged partial cross-sectional views of FIG. 2. FIGS. 2D-2E are, respectively, open and close positions of the pulsing tool 100. The pulsing tool 100 includes a tubular housing 108 having couplings 121, 122 at the upper and lower ends for connection to other downhole tools. The upper end may be connected to a conveyance string such as coiled tubing, jointed pipe, slickline, and other suitable downhole strings for running a downhole tool. In one embodiment, the upper end optionally includes an upper catch 120 configured to prevent breakage of the pulsing tool 100. The upper catch 120 includes a smaller diameter section 116 disposed between two larger diameter sections 117, 119. The smaller diameter section 116 is disposed through an opening 118 of the upper coupling 121. In the event the threaded connection of the upper coupling 121 fails, the upper catch 120 prevents the pulsing tool 100 from separating. Similarly, the lower end optionally includes a lower catch 125 configured to prevent separation of the pulsing tool 100 in the event the threaded connection of the lower coupling 122 fails. The lower catch 125 includes a smaller diameter section 126 disposed between two larger diameter sections 127, 129. The smaller diameter section 126 is disposed through an opening 128 of the upper coupling 121.

The pulsing tool 100 includes a motor unit 110, a pulsing unit 130, and a bearing unit 150. As shown, the motor unit 110 is a turbine type motor. The motor unit 110 includes one or more stages 115 of stationary vanes 111 and rotary vanes 112. In one example, the motor unit 110 is configured for left hand rotation and has more stationary vanes than rotary vanes. The motor shaft 105 of the motor unit 110 has a concentric running motion and provides rotation to the pulsing unit 130.

The pulsing unit 130 includes a rotating mandrel 131 having one or more inlet openings 132, one or more outlet openings 135, and one or more return openings 137 that fluidly communicate with a bore 143 in the mandrel 131. The mandrel 131 is coupled to and rotatable by motor shaft 105 of the motor unit 110. An outer annular area between the inlet openings 132 and the outlet openings 135 is closed off by a pulse control bushing 140 to the fluid flow from the motor unit 110 to enter the bore 143 of the rotating mandrel 131 through the inlet openings 132. The fluid then exits the bore 143 of the mandrel 131 through the outlet openings 135.

Figure 1D:
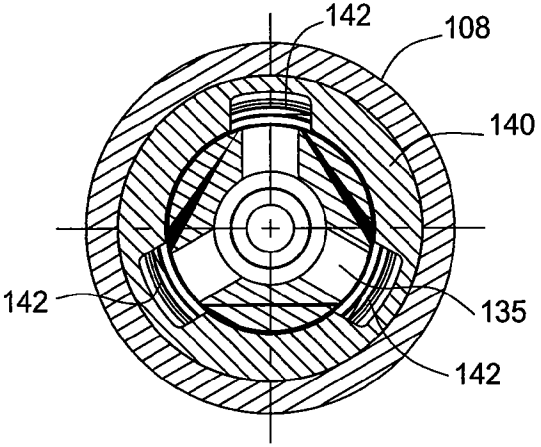
FIG. 1D is a cross-sectional of the pulsing tool of FIG. 1 along lines R1-R1.

The pulse control bushing 140 is configured to control the outflow of fluid through the outlet openings 135. FIG. 1D is a cross-sectional view of the outlet openings 135 and the pulse control bushing 140 disposed in the tubular housing 108. As shown, three outlet openings 135 are provided in the mandrel 131. The pulse control bushing 140 includes at least one fluid flow path. For example, as shown, three recesses 142 circumferentially spaced and aligned with the outlet openings 135. In this position, fluid is allowed to flow out of the mandrel 131 via the outlet openings 135. As the mandrel 131 rotates, for example 60 degrees, the outlet openings 135 may no longer be in alignment with the recesses 142. This position blocks the outlet openings 135, thereby preventing fluid from flowing out of the mandrel 131. Consequently, there is a temporary pressure increase in the pulsing unit 130 when the outlet openings 135 are blocked. The pressure is relieved when the outlet openings 135 rotate into alignment with the recesses 142. In this manner, rotation of the mandrel 131 causes intermittent increases and decreases to the fluid pressure of the main string. Although not intended to be bound by theory, it is believed the pressure oscillations cause the coiled tubing to vibrate. As a result, the coiled tubing is constantly moving during operation. The constant movement of the coiled tubing minimizes the static friction generated when the coiled tubing comes into contact with the wellbore. The fluid leaving the bushing 140 re-enters the mandrel 131 through the return openings 137.

In another embodiment, the frequency and the amplitude of the pressure oscillation may be customized for a particular application. The number, size, position, and combinations thereof of the outlet openings 135 and recesses 142 may be changed to fit a particular application. For example, the number of openings and/or recesses may be modified to change to the frequency. The number of openings 135 and the number of recesses 142 may be the same or different. For example, the mandrel may have four outlet openings 135 and two recesses 142. In another example, the relative positions of the openings/recesses may be asymmetrically or symmetrically positioned. In yet another example, the size of the openings/recesses may be changed to change amplitude. In one embodiment, the shape of the openings may have round, slot, or any suitable configuration. In one application, the frequency may be customized to be different from the frequency of another downhole tool, such as a measure-while-drilling tool, during drilling.

In another embodiment, the pulsing unit 130 may include a pressure relief nozzle 145 positioned in the bore 108 of the mandrel 131 to serve as a constant leak passage. The relief nozzle 145 may facilitate the start up of the motor unit 110 by ensuring a passage through the bore 108 for fluid flow. In one embodiment, the nozzle 145 may be retained by a threaded connection in the mandrel 131, which allows the nozzle 145 to be replaced more easily. One or more o-rings may be used to prevent leakage of fluid through the threaded connection. As shown, the up stream opening of the nozzle 145 is larger than the downstream opening. In one embodiment, the nozzle 145 is made of tungsten carbide. In another embodiment, the bore 108 of the mandrel 131 may be narrowed to simulate the function of the nozzle 145.

The bearing unit 150 is connected below the pulsing unit 130. The bearing unit 150 is configured to resist the hydraulic thrust resulting from the fluid pressure oscillation. In one embodiment, the bearing unit 150 includes a connection sleeve 157 coupled to and rotatable with the rotating mandrel 131. A radial bearing 152 and angular contact thrust bearings 154 are used to support the connection sleeve 157 in the tubular housing 108. The lower portion of the connection sleeve 157 may be coupled to the lower catch 125.

FIGS. 2D-2E show the flow of fluid through the pulsing unit 130 during operation. In the open position shown in FIG. 2D, fluid leaving the motor unit 140 flow down the annular area between the mandrel 131 and the tubular housing 108. The fluid then enters the bore 143 of the mandrel 131 through the inlet openings 132. The fluid exits the bore 143 through the outlet openings 135, when the pulsing unit 130 is in the open position. If the optional relief nozzle 145 is present, some of the fluid may flow through the nozzle 145. The exiting fluid flow through the recess 142 of the pulse control bushing 140 and down the annular area between the mandrel 131 and the tubular housing 108 before re-entering the bore 143 through the return openings 137. After re-entering, the fluid continues down the bore 143 to another section of the conveyance string or another component coupled to the conveyance string.

In the closed position shown in FIG. 2E, fluid leaving the motor unit 140 flow down the annular area between the mandrel 131 and the tubular housing 108. The fluid then enters the bore 143 of the mandrel 131 through the inlet openings 132. However, because the outlet opening 135 is not aligned with the recess 142 of the bushing 140, the fluid is prevented from flowing out of the bore 143 via the outlet openings 135. Instead, the fluid flows through the nozzle 145 and continue down the bore 143 to another section of the conveyance string or another component coupled to the conveyance string. As discussed above, when the outlet opening 135 is blocked, a temporary pressure increase is created in the pulsing unit 130. The pressure is relieved when the outlet openings 135 are aligned with the recesses 142. It is believed that the pressure oscillation in the conveyance string causes the conveyance string to vibrate. As a result, the conveyance string is in constant motion which minimizes the static friction that may be generated when the conveyance string comes into contact with the wellbore. In one example, a coiled tubing may straighten when the pressure is increased and may flex when the pressure is relieved. This constant motion of the coiled tubing may cause the coiled tubing to skip along the surface of the wellbore, thereby minimizing the effect of static friction on the coiled tubing.

Figure 3:
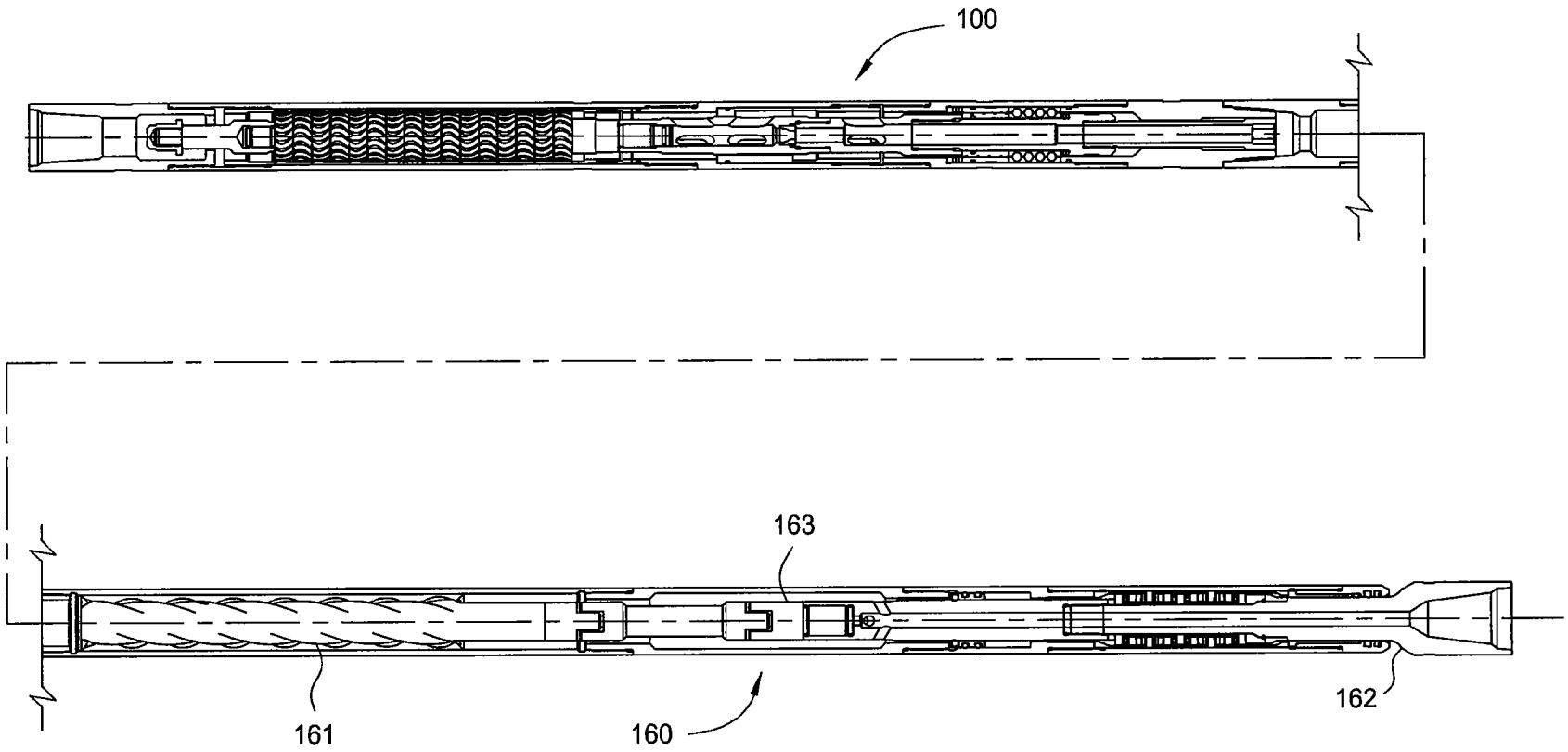
FIG. 3 shows the pulsing tool of FIG. 2 connected to an exemplary drilling tool for a drilling operation.

FIG. 3 illustrates an exemplary embodiment of the pulsing tool 100 connected to a drilling tool 160 for a drilling operation. The drilling tool 160 includes a positive displacement motor 161 having a drive shaft 162 for connection to a drill bit or other downhole device requiring torque. The drilling tool 160 uses a universal joint 163 to transmit torque from the motor 161 to the drive shaft 162. In this embodiment, the pulsing tool 100 rotates independently from the drilling tool 160.

Figure 4:
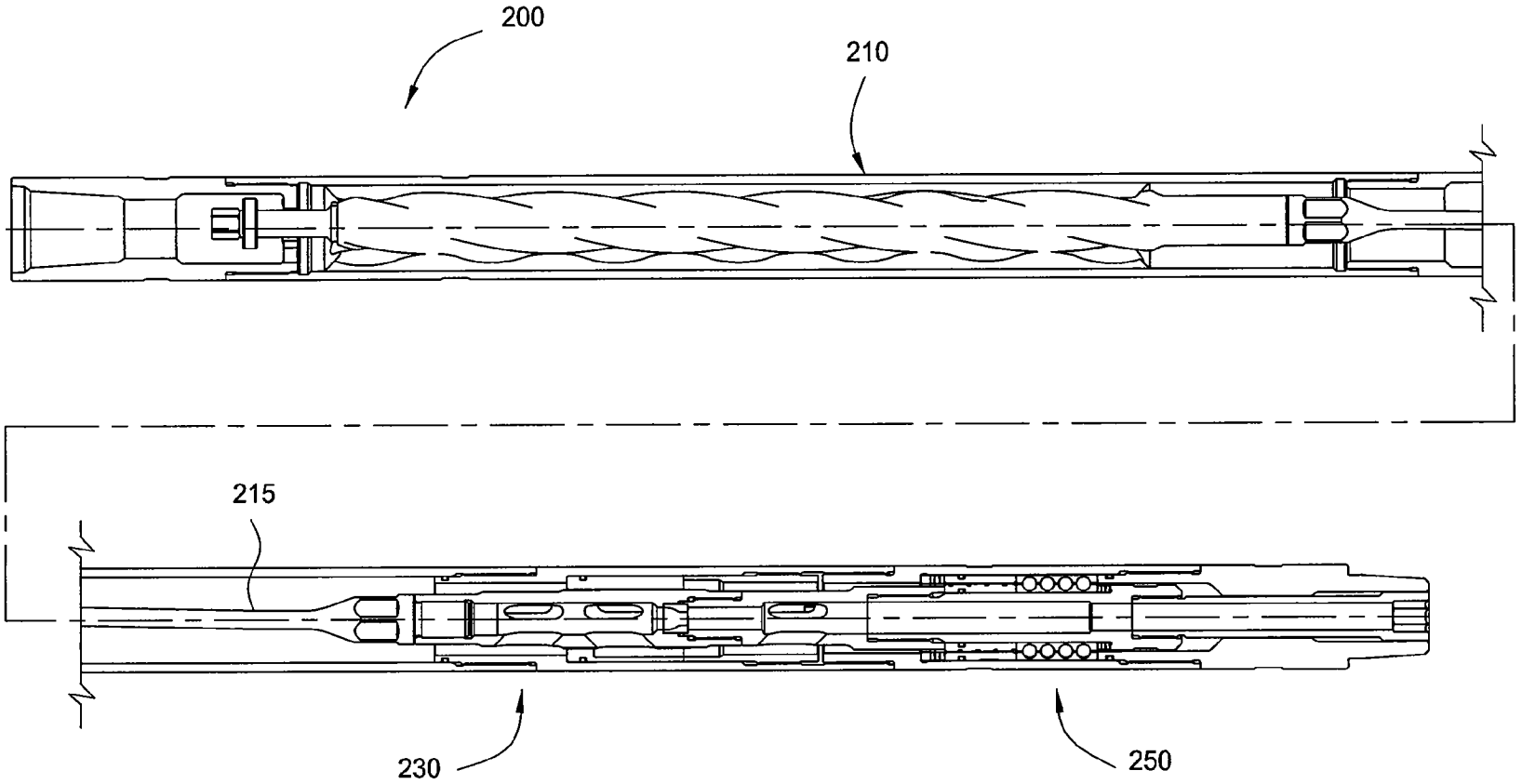
FIG. 4 illustrates another embodiment of a pulsing tool.

FIG. 4 illustrate another embodiment of a pulsing tool 200. This embodiment 200 is substantially similar to the pulsing tool 100 of FIG. 1, except the motor unit 210 is a positive displacement type motor, also commonly known as "mud motor". In the interest of clarity, the pulsing unit 230 and bearing unit 250 will not be described in detail. Because the power unit 210 has an orbital motion, a coupling transmission is used to convert the orbital motion into concentric rotary motion for the pulsing unit 230. As shown, a flexible shaft 215 is used as a coupling transmission to transmit torque from the motor unit 210 to the pulsing unit 230. In another embodiment, a universal joint transmission may be used.

Figure 5:
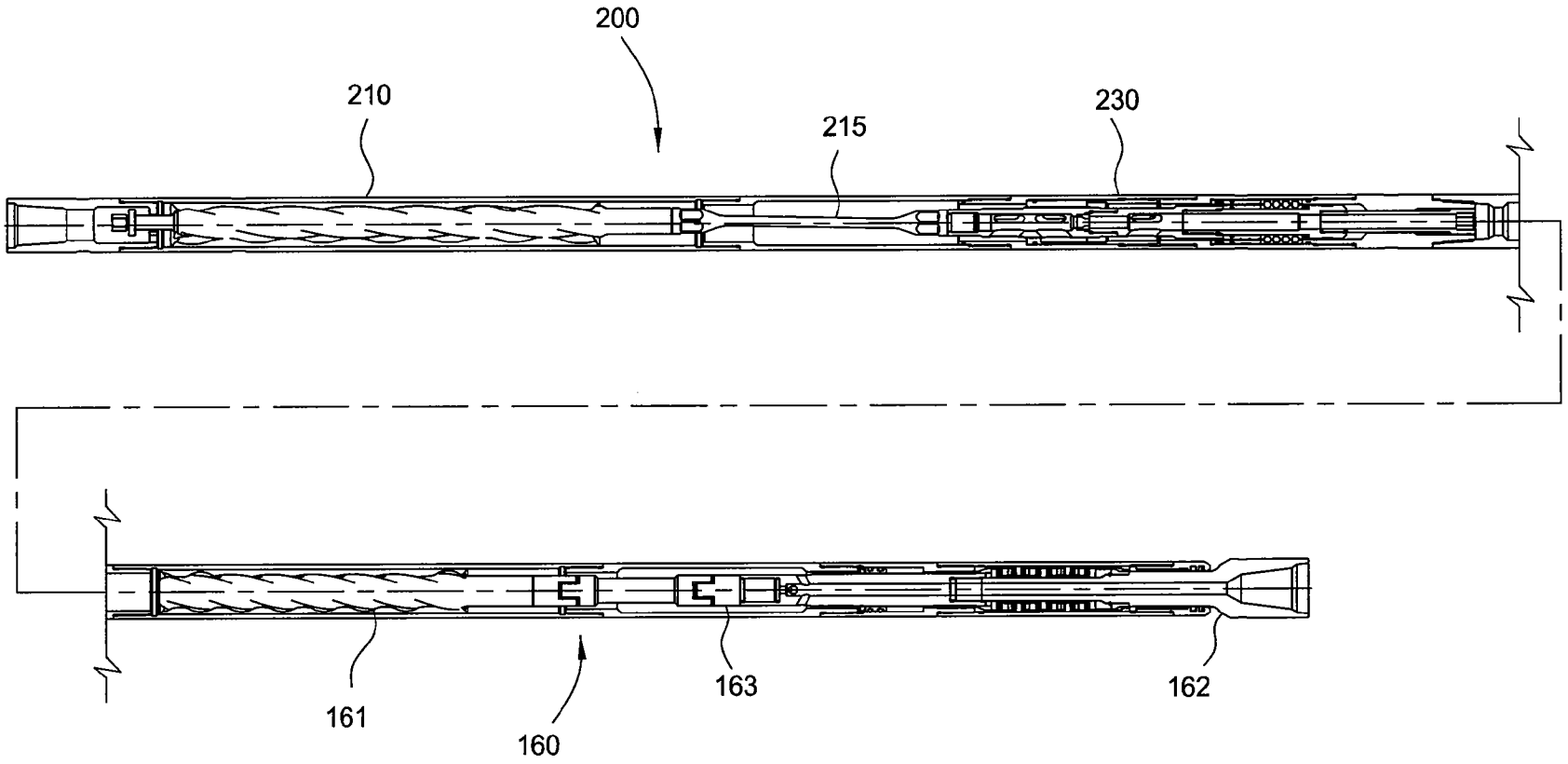
FIG. 5 illustrates the pulsing tool of FIG. 4 connected to an exemplary drilling tool for a drilling operation.

FIG. 5 illustrates an exemplary embodiment of the pulsing tool 200 connected to a drilling tool 160 for a drilling operation. The drilling tool 160 includes a positive displacement motor 161 having a drive shaft 162 for connection to a drill bit or other downhole device requiring torque. The drilling tool 160 uses a universal joint 163 to transmit torque from the motor 161 to the drive shaft 162. In contrast with the drilling tool 160, the pulsing tool 200 uses a flexible shaft 215 to transmit torque from the motor unit 210 to the pulsing unit 230. However, it is contemplated that either or both tools 160, 200 may use a universal joint, flexible shaft, or other suitable transmission devices to transmit torque.

Figure 6:
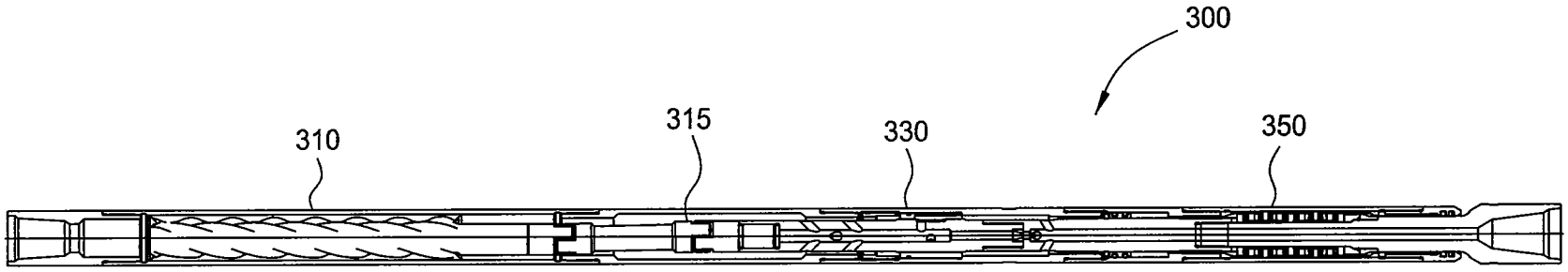
FIG. 6 illustrates another embodiment of a pulsing tool.
Figures 7A, 7B, 7C:
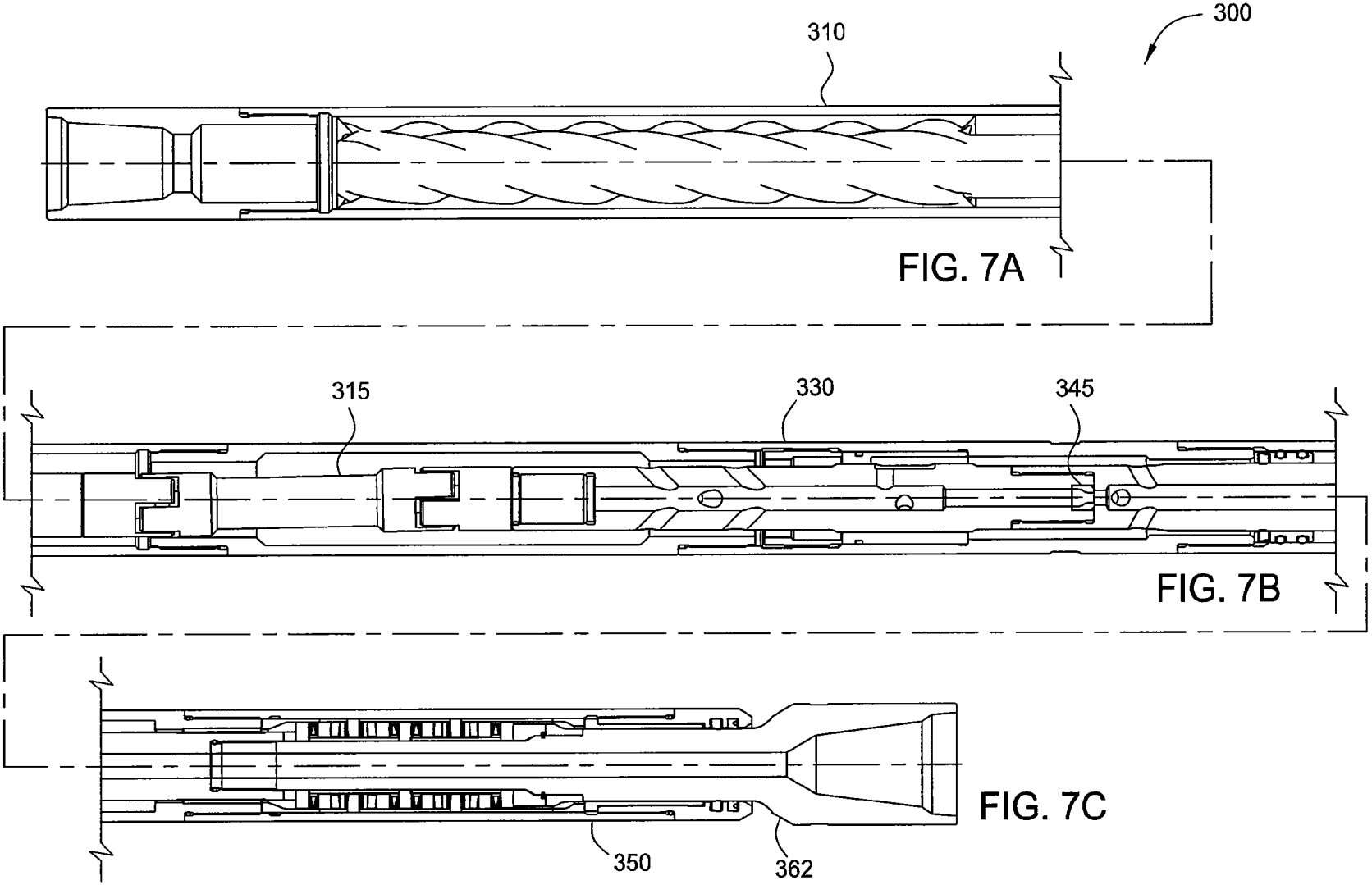
FIGS. 7A-7C are enlarged views of the pulsing tool of FIG. 6.

FIG. 6 illustrates another embodiment of a pulsing tool 300. FIGS. 7A-7C are enlarged views of the pulsing tool 300 of FIG. 6. In this embodiment, the pulsing unit 330 is integrated with the drilling tool. In particular, the pulsing tool 300 includes a pulsing unit 330 coupled to the motor unit 310 using a connection member such as a universal joint, a flexible joint, and a connection joint. The bearing unit 350 is connected downstream from the pulsing unit 330. A drive shaft 362 is coupled to the bearing unit 350. In this respect, the motor unit 310 provides the torque for turning the pulsing unit 330 and the drive shaft 362. The bearing unit 350 provides axial and radial support to the drive shaft used to drive the drilling bit. In this embodiment, the openings in the pulsing unit 330 are optionally, round openings instead of slot type openings. The round openings are axially spaced to maintain axial integrity of the rotating mandrel. The pulsing unit 330 also includes a relief nozzle 345.

In another embodiment, the pulsing unit may be attached to a tubular string equipped with a motor. For example, the pulsing unit may be modular unit that can be added or removed from a tubular string as needed. In another embodiment, the pulsing unit may be added to a tubular string equipped with a downhole tool such as a drill bit and a motor for driving the downhole tool. After attachment, the motor may be used to drive the pulsing unit as well as the downhole tool. The pulsing unit may be arranged upstream or downstream from the motor and/or the downhole tool.

Figures 8A, 8B, 8C, 8D, 8E, 8F, 8G:
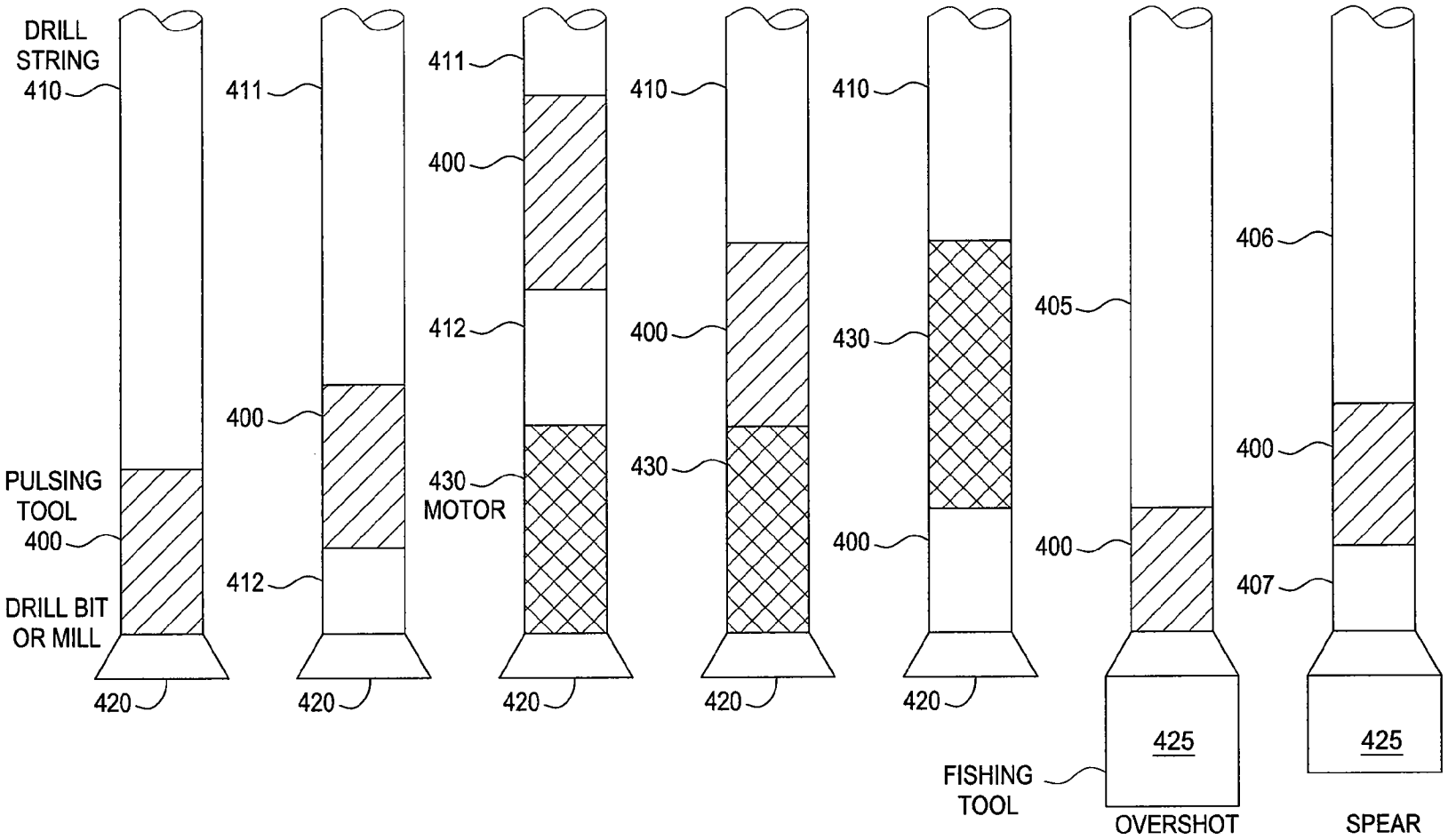
FIG. 8A shows an exemplary embodiment of a drilling assembly.
FIG. 8B shows another embodiment of a drilling assembly.
FIG. 8C shows another embodiment of a drilling assembly.
FIG. 8D shows another embodiment of a drilling assembly.
FIG. 8E shows another embodiment of a drilling assembly.
FIG. 8F shows an exemplary embodiment of a fishing tool assembly.
FIG. 8G shows another embodiment of a fishing tool assembly.

Embodiments of the pulsing tool may be arranged in a variety of positions relative to a conveyance string and other components on the string. FIG. 8A shows an exemplary embodiment of a drilling assembly having a drill string 410, a pulsing tool 400, and a drill bit or a mill 420 at a lower end.

FIG. 8B shows another embodiment of a drilling assembly having a pulsing tool 400 connected between a first drill string section 411 and a second drill string section 412. The drill bit or mill 420 is connected to a lower end of the second drill string section 412.

FIG. 8C shows another embodiment of a drilling assembly having a pulsing tool 400 connected between a first drill string section 411 and a second drill string section 412. A motor 430 is connected to a lower end of the second drill string section 412. The drill bit or mill 420 is connected to and rotatable by the motor 430.

FIG. 8D shows an exemplary embodiment of a drilling assembly having a drill string 410, a pulsing tool 400, and a motor 430 connected below the pulsing tool 400. The motor 430 may be used to rotate a drill bit or a mill 420 at a lower end, and optionally, the pulsing tool 400.

FIG. 8E shows an exemplary embodiment of a drilling assembly having a drill string 410 and a motor 430 connected above the pulsing tool 400. The motor 430 may be used to rotate a drill bit or a mill 420 at a lower end as well as the pulsing tool 400.

FIG. 8F shows an exemplary embodiment of a fishing tool assembly having a conveyance string 405, a pulsing tool 400, and an overshot or spear 425 connected to a lower end of the pulsing tool 400. In one embodiment, the fishing tool may be used to retrieve a stuck object in the wellbore. The vibration generated by the pulsing tool 400 may be operated to apply a pulsing, e.g., push and/or pull, force on the object to attempt to free the object.

FIG. 8G shows another embodiment of a fishing tool assembly having a pulsing tool 400 connected between a first conveyance string section 406 and a second conveyance string section 407. The overshot or spear 425 is connected to a lower end of the second conveyance string section 407.

A pulsing tool for use with a tubular string having a motor unit and a pulsing unit coupled to the motor unit. In one embodiment, the pulsing unit includes a mandrel having an inlet opening and an outlet opening and a flow control bushing, wherein rotation of the mandrel relative to the flow control bushing creates a pressure oscillation which causes movement of the tubular string.

In one or more the embodiments described herein, the flow control bushing includes a fluid flow path selectively aligned with the outlet opening.

In one or more the embodiments described herein, a pressure in the pulsing unit increases in the pulsing unit when the outlet opening is not aligned with the fluid flow path.

In one or more the embodiments described herein, the pressure is relieved with the outlet opening is aligned with the fluid flow path.

In one or more the embodiments described herein, the mandrel further comprises a return opening for returning fluid exiting the outlet opening back into the mandrel.

In one or more the embodiments described herein, the mandrel further comprises a return opening for returning fluid exiting the outlet opening back into the mandrel.

In one or more the embodiments described herein, the mandrel is rotated by the motor unit to the place the outlet opening into or out of alignment with the fluid flow path.

In one or more the embodiments described herein, the pulsing tool includes a tubular housing and an annular area disposed between the tubular housing and the mandrel, wherein the annular area between inlet opening and the outlet opening is blocked from fluid communication.

In one or more the embodiments described herein, the annular area is blocked by the flow control bushing.

In one or more the embodiments described herein, the pulsing tool includes a nozzle disposed in the mandrel and downstream from the inlet opening.

In one or more the embodiments described herein, the pulsing tool includes a catch member configured to prevent separation of the pulsing tool.

In one or more the embodiments described herein, the pulsing unit is coupled to the motor unit using a flexible shaft, a universal joint, a connection joint, and combinations thereof.

In one or more the embodiments described herein, wherein the motor unit is a turbine motor, a positive displacement motor, a mud motor, and combinations thereof.

In one or more the embodiments described herein, the tubular string comprises a coiled tubing.

In one or more the embodiments described herein, the pulsing tool includes a drive shaft coupled to the pulsing unit and rotatable by the motor unit. In another embodiment, the drive shaft may be used to drive a drill bit.

In another embodiment, a method of moving a tubular string includes coupling the string to a pulsing tool having a motor unit; a pulsing unit having an inlet opening and an outlet opening configured to generate a pressure oscillation in the tubular string; flowing a fluid through the motor unit and then into the pulsing unit via the inlet opening; and periodically allowing the fluid to flow out of the pulsing unit via the outlet opening, thereby generating the pressure oscillation to cause the string to move.

In one or more the embodiments described herein, the pulsing unit includes a flow control bushing having a fluid flow path, whereby the fluid is allowed to periodically flow out of the pulsing unit when the outlet opening is aligned with the fluid flow path.

In one or more the embodiments described herein, a portion of the fluid is allowed to flow through a nozzle disposed in the bore after entering the inlet opening.

In one or more the embodiments described herein, the mandrel is rotated using the motor unit to periodically place the outlet opening in alignment with the fluid flow path.

In one or more the embodiments described herein, the fluid exiting the outlet opening is returned into the mandrel via a return opening.

In one or more the embodiments described herein, a downhole tool is attached to the tubular string and moving the downhole tool with the tubular string. In another embodiment, the downhole is a fishing tool or a drill bit.

In another embodiment, a pulsing tool for use with a tubular string includes a housing; a rotatable mandrel disposed in the housing, the mandrel having an inlet opening and an outlet opening; and a flow control bushing disposed between the housing and the mandrel, wherein rotation of the mandrel relative to the flow control bushing creates a pressure oscillation which causes movement of the tubular string.

In one or more the embodiments described herein, the flow control bushing includes a fluid flow path.

In one or more the embodiments described herein, rotation of the mandrel places the outlet opening in selective fluid communication with the flow path.

In one or more the embodiments described herein, the mandrel is rotated using a motor unit.

In one or more the embodiments described herein, the pulsing unit may be a modular component that can be connected to a tubular string equipped with a motor, whereby the motor can be used to drive the pulsing unit.

While the foregoing is directed to embodiments of the present invention, other and further embodiments of the invention may be devised without departing from the basic scope thereof, and the scope thereof is determined by the claims that follow.

What is claimed is:

1. A pulsing tool for use with a tubular string, comprising:
a motor unit;
a pulsing unit coupled to the motor unit, the pulsing unit including:
a mandrel having an inlet opening in fluid communication with an outlet opening; and
a flow control bushing disposed around the outlet opening, wherein the inlet opening is in continuous fluid communication with the motor unit during rotation of the mandrel relative to the flow control bushing,
wherein the flow control bushing is configured to periodically block the outlet opening from fluid communication during rotation of the mandrel relative to the flow control bushing, thereby creating a pressure oscillation which causes movement of the tubular string; and
a tubular housing and an annular area disposed between the tubular housing and the mandrel, wherein the annular area between inlet opening and the outlet opening is blocked from fluid communication.

2. The tool of claim 1, wherein the flow control bushing includes a fluid flow path selectively aligned with the outlet opening.

3. The tool of claim 2, wherein a pressure in the pulsing unit increases in the pulsing unit when the outlet opening is not aligned with the fluid flow path.

4. The tool of claim 3, wherein the pressure is relieved with the outlet opening is aligned with the fluid flow path.

5. The tool of claim 4, wherein the mandrel further comprises a return opening for returning fluid exiting the outlet opening back into the mandrel.

6. The tool of claim 2, wherein the mandrel further comprises a return opening for returning fluid exiting the outlet opening back into the mandrel.

7. The tool of claim 6, wherein the mandrel further comprises a bore in fluid communication with the inlet opening, the outlet opening, and the return opening.

8. The tool of claim 7, wherein the mandrel further comprises a nozzle disposed in the bore between the outlet opening and the return opening.

9. The tool of claim 2, wherein the mandrel is rotated by the motor unit to place the outlet opening into or out of alignment with the fluid flow path.

10. The tool of claim 1, wherein the annular area is blocked by the flow control bushing.

11. The tool of claim 1, further comprising a nozzle disposed in the mandrel and downstream from the inlet opening.

12. The tool of claim 1, further comprising a catch member configured to prevent separation of the pulsing tool.

13. The tool of claim 1, wherein the outlet opening is formed through a wall of the mandrel.

14. A method of moving a tubular string, comprising:
coupling the string to a pulsing tool having:
a motor unit;
a pulsing unit having an inlet opening and an outlet opening formed in a mandrel configured to generate a pressure oscillation in the tubular string, wherein the inlet opening is in fluid communication with the outlet opening; and a flow control bushing disposed around the outlet opening and configured to periodically block the outlet opening from fluid communication;

flowing a fluid through the motor unit and then into the mandrel via the inlet opening;

a tubular housing and an annular area disposed between the tubular housing and the mandrel, wherein the annular area between inlet opening and the outlet opening is blocked from fluid communication; and while maintaining the inlet opening in fluid communication with motor unit, periodically allowing the fluid to flow out of the mandrel via the outlet opening, thereby generating the pressure oscillation to cause the string to move.

15. The method of claim 14, wherein the flow control bushing includes a fluid flow path, whereby the fluid is allowed to periodically flow out of the mandrel when the outlet opening is aligned with the fluid flow path.

16. The method of claim 15, wherein the inlet opening and the outlet opening are in fluid communication with a bore of the mandrel.

17. The method of claim 16, further comprising allowing a portion of the fluid to flow through a nozzle disposed in the bore after entering the inlet opening.

18. The method of claim 16, further comprising using the motor unit to rotate the mandrel to periodically place the outlet opening in alignment with the fluid flow path.

19. The method of claim 18, further comprising continually rotate the mandrel in the same direction to alternately place the outlet opening in alignment and out of alignment with the fluid flow path.

20. The method of claim 14, further comprising returning the fluid exiting the outlet opening into the mandrel via a return opening.

21. The method of claim 14, further comprising attaching a downhole tool to the tubular string and moving the downhole tool with the tubular string.

22. The method of claim 21, wherein the downhole is a fishing tool or a drill bit.

23. A pulsing tool for use with a tubular string, comprising:

a housing;

a rotatable mandrel disposed in the housing, the mandrel having an inlet opening in fluid communication with an outlet opening; and a flow control bushing disposed around the mandrel and between the housing and the mandrel, a tubular housing and an annular area disposed between the tubular housing and the mandrel, wherein the annular area between inlet opening and the outlet opening is blocked from fluid communication; and wherein rotation of the mandrel relative to the flow control bushing creates a pressure oscillation which causes movement of the tubular string, and wherein the inlet opening remains open during rotation of the mandrel.

24. The tool of claim 23, wherein the flow control bushing includes a fluid flow path.

25. The tool of claim 24, wherein rotation of the mandrel places the outlet opening in selective fluid communication with the flow path.

26. The tool of claim 23, wherein the mandrel is rotated using a motor unit.

27. A pulsing tool for use with a tubular string, comprising:

a motor unit;

a pulsing unit coupled to the motor unit, the pulsing unit including:

a mandrel having an inlet opening in fluid communication with an outlet opening; and a flow control bushing, a tubular housing and an annular area disposed between the tubular housing and the mandrel, wherein the annular area between inlet opening and the outlet opening is blocked from fluid communication;

wherein the inlet opening is in continuous fluid communication with the motor unit during rotation of the mandrel relative to the flow control bushing, and wherein rotation of the mandrel relative to the flow control bushing creates a pressure oscillation which causes movement of the tubular string; and a nozzle disposed in the mandrel and downstream from the inlet opening.

28. A pulsing tool assembly, comprising:

a motor unit;

a pulsing unit coupled to the motor unit, the pulsing unit including:

a mandrel having an inlet opening in fluid communication with an outlet opening; and a flow control bushing, a tubular housing and an annular area disposed between the tubular housing and the mandrel, wherein the annular area between inlet opening and the outlet opening is blocked from fluid communication;

wherein the inlet opening is in continuous fluid communication with the motor unit during rotation of the mandrel relative to the flow control bushing, and wherein rotation of the mandrel relative to the flow control bushing creates a pressure oscillation which causes movement of the tubular string; and a coiled tubing coupled to the motor unit.

29. A pulsing tool assembly, comprising:

a motor unit;

a pulsing unit coupled to the motor unit, the pulsing unit including:

a mandrel having a bore and an inlet opening in fluid communication with an outlet opening via the bore;

a tubular housing;

an annular area defined between the tubular housing and the mandrel, wherein the annular area between inlet opening and the outlet opening is blocked from fluid communication;

a return opening in fluid communication with the bore; and a flow control bushing;

wherein rotation of the mandrel relative to the flow control bushing creates a pressure oscillation which causes movement of the tubular string; and wherein the inlet opening is in continuous fluid communication with the motor unit during rotation of the mandrel relative to the flow control bushing.

30. A method of moving a tubular string, comprising:

coupling the string to a pulsing tool having:

a motor unit;

a pulsing unit having a mandrel, an inlet opening and an outlet opening configured to generate a pressure oscillation in the tubular string, wherein the inlet opening is in fluid communication with the outlet opening;

flowing a fluid through the motor unit and then into the mandrel via the inlet opening;

periodically allowing a first portion of the fluid to flow out of the mandrel via the outlet opening, thereby generating the pressure oscillation to cause the string to move;

returning the first portion of the fluid exiting the outlet opening into the mandrel via a return opening; and combining the first portion with a second portion of the fluid in the mandrel, wherein the inlet opening is in continuous fluid communication with the motor unit during rotation of the mandrel relative to the flow control bushing.

* * * * *